US005445060A

United States Patent [19]

Randall et al.

[11] Patent Number: 5,445,060

[45] Date of Patent: Aug. 29, 1995

[54] FLOATING FLUID ACTUATED CYLINDER

[75] Inventors: Frederick Randall, Montclair; Alfred J. Raven, III, Morganville, both of N.J.

[73] Assignee: Randall Manufacturing Co., Inc., Hillside, N.J.

[21] Appl. No.: 300,706

[22] Filed: Sep. 2, 1994

[51] Int. Cl.[6] ..... F01B 15/04

[52] U.S. Cl. ..... 92/118; 92/117 R; 92/161

[58] Field of Search ..... 92/117 R, 118, 119, 92/66, 146, 161; 91/196, 216 R

[56] References Cited

U.S. PATENT DOCUMENTS

| | | | |
|---|---|---|---|
| 858,113 | 6/1907 | Smith . | |
| 2,146,346 | 2/1936 | Nelson | 92/117 R |
| 2,236,266 | 3/1941 | Hewitt . | |
| 2,411,229 | 11/1946 | Pratt . | |
| 3,183,795 | 5/1965 | Kirk . | |
| 3,314,336 | 4/1967 | Jorgi | 92/118 |
| 3,592,303 | 7/1971 | Tincher . | |
| 3,880,053 | 4/1975 | Trachel et al. . | |
| 4,089,253 | 5/1978 | Visser . | |
| 4,423,515 | 12/1983 | Riegler et al. | 92/117 R |
| 4,532,856 | 8/1985 | Taylor . | |
| 4,944,215 | 7/1990 | Nimmo et al. . | |
| 5,105,917 | 4/1992 | Sporzynski et al. . | |
| 5,299,587 | 4/1994 | Randall et al. . | |

FOREIGN PATENT DOCUMENTS

| | | | |
|---|---|---|---|
| 1387356 | 3/1975 | United Kingdom | 92/118 |
| 2077391 | 12/1981 | United Kingdom | 92/118 |

*Primary Examiner*—Thomas E. Denion
*Attorney, Agent, or Firm*—Plevy & Associates

[57] ABSTRACT

A fluid actuated cylinder in combination with a container, the cylinder operating to lower an object into the container and to raise the object out of the container. The cylinder and container comprise a cylinder, a mounting assembly attached to the wall of the container for mounting the cylinder to the wall of the container. A cylinder a pivot bearing arrangement associated with the cylinder and the cylinder mounting assembly is provided for allowing the cylinder to move laterally in an orbital motion with respect to the cylinder mounting assembly when the cylinder is subjected to bending torques resulting from the lowering and raising of the object.

18 Claims, 7 Drawing Sheets

FLOATING FLUID ACTUATED CYLINDER

FIELD OF THE INVENTION

This invention relates generally to a fluid actuated cylinder and more particularly to an improved fluid actuated cylinder having means for allowing the cylinder to float with respect to its mounting fixture thereby reducing wear and fluid leakage within the cylinder as when a load causes the misalignment of the piston rod with respect to the longitudinal axis of the cylinder.

BACKGROUND OF THE INVENTION

Fluid actuated cylinders are used extensively in industrial manufacturing processes including both light and heavy machinery. For instance, fluid actuated cylinders are employed to open and closed industrial tank covers, in reciprocating squeegee assemblies, for immersing cleaning baskets containing machine parts in cleaning tanks, and any other application where the reciprocating motion of the cylinder assembly can be harnessed to perform a particular task.

Referring to FIG. 1, there is shown a typical prior art fluid actuated cylinder 10 comprising a cylinder body 12 having a closed end 14 and an open end 16. The cylinder body 12 presents a bore 18 for receiving a piston rod assembly 20 comprising a piston 22 and piston rod 24. The piston rod assembly 20 reciprocates within the bore 18 along the longitudinal axis 26 of the cylinder body 12. The free end 28 of the piston rod extends through the open end 16 of the cylinder body 12 and is adapted to be connected to an object to be operated either directly or by some sort of linkage arrangement.

A pair of spaced apart ports 30 and 32 are provided on the cylinder body 12 for receiving and exhausting either air or a hydraulic oil depending upon whether the cylinder assembly is designed to be actuated pneumatically or hydraulically. The first port 30 is located adjacent to the closed end 14 of the cylinder body 12 and operates to supply air or oil to the cylinder 10. The second port 32 is located adjacent the open end 16 of the cylinder body 12 and operates to exhaust the air or oil from the cylinder 10.

Problems can arise when the above-described cylinder is employed in an application where the reciprocating piston rod assembly is connected to the object to be operated by a linkage arrangement. In such applications, the geometry of the linkage transfers bending torques to the piston rod of the cylinder. These bending torques can be quite substantial if the object being operated is heavy and can cause binding and bending of the piston rod. This in turn can cause premature wear of the piston and or cylinder bore. The bending torques can also cause premature wear of the bearings in the connecting linkage.

An application where these bending torques can be extreme is where the cylinder is implemented for the purpose of lifting baskets or containers of parts in and out of immersion cleaning devices. Immersion cleaning devices are employed in many different industries to clean various items such as newly machined metal parts. An example of such an immersion cleaning device is shown in U.S. Pat. No. 5,299,587 entitled ROTATING AND RECIPROCATING IMMERSION CLEANING APPARATUS AND METHOD issued to Frederick Randall et al. and assigned to Randall Manufacturing Company, the assignee herein. To increase productivity, it is desirable to clean these parts in bulk. Typically, the parts are loaded into baskets or other like containers and then immersed into a cleaning tank. Since the baskets are heavy and awkward, it is desirable to lower and raise the baskets mechanically. The employment of fluid actuated cylinders for such purposes is well known.

In FIGS. 2A and 2B, the prior art fluid actuated cylinder 10 of FIG. 1 is shown in conjunction with an immersion cleaning device. The immersion cleaning device comprises a tank 40 and includes a rear side wall 42. The cylinder 10 is secured to the rear side wall 42 of the tank 40 by a mounting assembly comprising a pair of vertically extending U-shaped guide channels 58 and 60. The open portion of the channels are oriented in opposing relationship with each other. A horizontally extending bottom mounting plate 54 couples the pair of guide channels 58 and 60 together at their lower most ends and supports the closed end 14 of cylinder body 12. A horizontally extending upper mounting plate 56 extends between the pair of guide channels in a location adjacent to the open end 16 of cylinder body 12. An upper spacer bracket 46 and lower spacer bracket 44 provides a structure on the wall of the tank for fastening the mounting assembly to the tank.

The closed end 14 of cylinder body 12 includes a cylinder mounting dowel 52 which is received by an aperture formed in the bottom mounting plate 54. This arrangement assures that the lower most portion of the cylinder 10 is securely abutting against the lower spacer bracket 44 thereby providing a fixed mounting of the lower most end of the cylinder body 12.

The marginal upper most portion of the cylinder body 12 is rigidly mounted via the upper mounting plate 56 such that it abuts against the upper spacer bracket 46. This prevents side to side and front to rear movement of the cylinder.

The free end 28 of the piston rod 24 is coupled to a horizontally extending linkage member 48 which extends over the interior of the tank 40. An elevator shaft 50 depends vertically from the linkage member 48. The end of the elevator shaft 50 is adapted to hold a basket (not shown) which contains the parts to be immersed within the cleaning fluid of the tank 40. A sliding block 62 is coupled to the linkage member 48 just above the free end 28 of piston rod 24. Each end of the sliding block 62 rides up and down in a corresponding guide channel to vertically guide the linkage 48 and elevator shaft 50 so that the basket is lowered in and raised out of the tank 40 as the piston rod assembly 20 reciprocates within the cylinder body 12.

The rigid mounting of both the marginal upper end of the cylinder and the lower most end of the cylinder prevents the cylinder from moving or aligning itself in response to the bending torques that are exerted against it as the piston rod assembly 20 reciprocates within the cylinder body 12.

The prior art has attempted to solve the above-described problem by providing various techniques for allowing the cylinder to move or float in response to various bending forces acting upon the cylinder. For example, U.S. Pat. No. 4,944,215 issued to Nimmi on Jul. 31, 1990, entitled FLUID ACTIVATED CYLINDER ASSEMBLY WITH A FLOATING CYLINDER HEAD discloses a cylinder wherein the piston shaft is free to move through a predetermined range within the cylinder. This is accomplished by using a fairly complex piston rod seal and spherical piston arrangement.

It is therefore, an object of the present invention to provide an improved fluid actuated cylinder which comprises a standard piston rod assembly and means for allowing the cylinder to float with respect to its mounting fixture thereby preventing wear and fluid leakage of the cylinder as a result of misalignment of the piston rod with respect to the longitudinal axis of the cylinder.

SUMMARY OF THE INVENTION

A fluid actuated cylinder in combination with a container, the cylinder operating to lower an object into the container and to raise the object out of the container. The cylinder and container comprise cylinder mounting means attached to the wall of the container for mounting the cylinder to the wall of the container. Cylinder floating means associated with the cylinder and the cylinder mounting means is also provided for allowing the cylinder to move laterally in an orbital motion with respect to the cylinder mounting means when the cylinder is subjected to bending torques resulting from the lowering and raising of the object.

DETAILED DESCRIPTION OF THE DRAWINGS

Although the present invention can be used in many different applications where a pneumatic or hydraulic cylinder experiences bending moments, the floating fluid actuated cylinder of the present invention is especially suitable for use in conjunction with an industrial parts washer. Accordingly, the present invention will be described in conjunction with an industrial parts washer.

Figure 3:
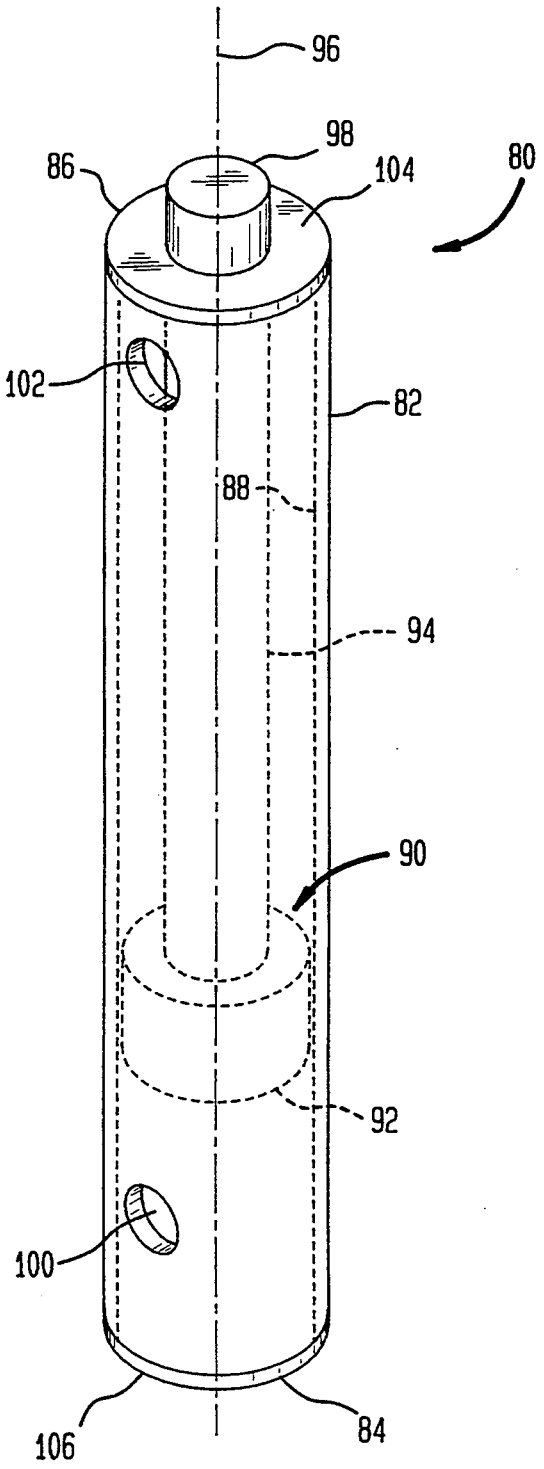
FIG. 3 is a perspective view of the fluid actuated cylinder according to the present invention.

Referring to FIG. 3, there is shown an exemplary embodiment of a fluid actuated cylinder 80 according the present invention the internal structure of which is shown with broken lines. Cylinder 80 comprises a cylinder body 82 having a first open end 84 and a second open end 86. The cylinder body 82 presents a bore 88 for receiving a piston rod assembly 90. The piston rod assembly 90 comprises a piston 92 and piston rod 94. The piston rod assembly 90 reciprocates within the bore 88 along the longitudinal axis 96 of the cylinder body 82.

Figure 6:
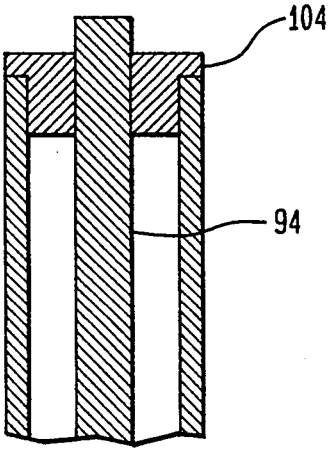
FIG. 6 is a fragmentary cross-sectional view of the upper bushing of the cylinder of the present invention.

A bushing 104 is press-fitted into the open end 86 of the cylinder body 82 as is best shown in FIG. 6. The free end 98 of the piston rod extends through an aperture provided in bushing 104. The bushing 104 functions as a bearing to support the piston rod 94 at the open end of the cylinder body 82 thus preventing the bending of the piston rod 94.

Figure 5A:
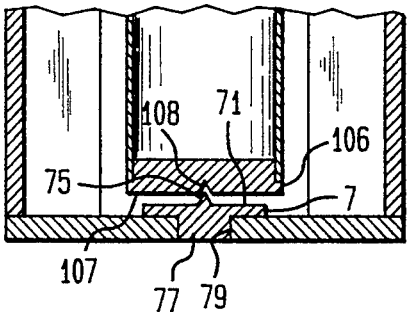
FIG. 5A is a enlarged fragmentary cross-sectional view of the cylinder mounting arrangement shown in FIGS. 4A and 4B.
Figure 5B:
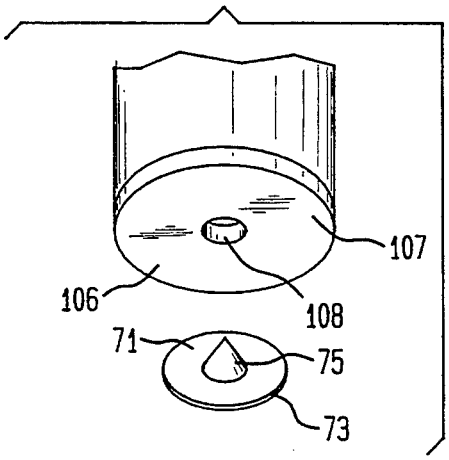
FIG. 5B is an exploded view of the floating pivot arrangement shown in FIGS. 4A, 4B and 5A.

As best shown in FIGS. 5A and 5B, an end cap 106 is press-fitted into the open end 84 of the cylinder body 82. The end cap 106 includes a centrally located conically shaped recess 108 and a bearing surface 107, the purpose of which will be described shortly.

Referring again to FIG. 3, a pair of spaced apart ports 100 and 102 are provided on the cylinder body 82 for receiving and exhausting either air or a hydraulic oil depending upon whether the cylinder assembly is designed to be actuated pneumatically or hydraulically just as in the above-described prior art cylinder. The first port 100 is located adjacent to the closed end 84 of the cylinder body 82 and operates to supply air or oil to the cylinder 80. The second port 102 is located adjacent the open end 86 of the cylinder body 82 and operates to exhaust the air or oil from the cylinder 80.

Figure 4A:
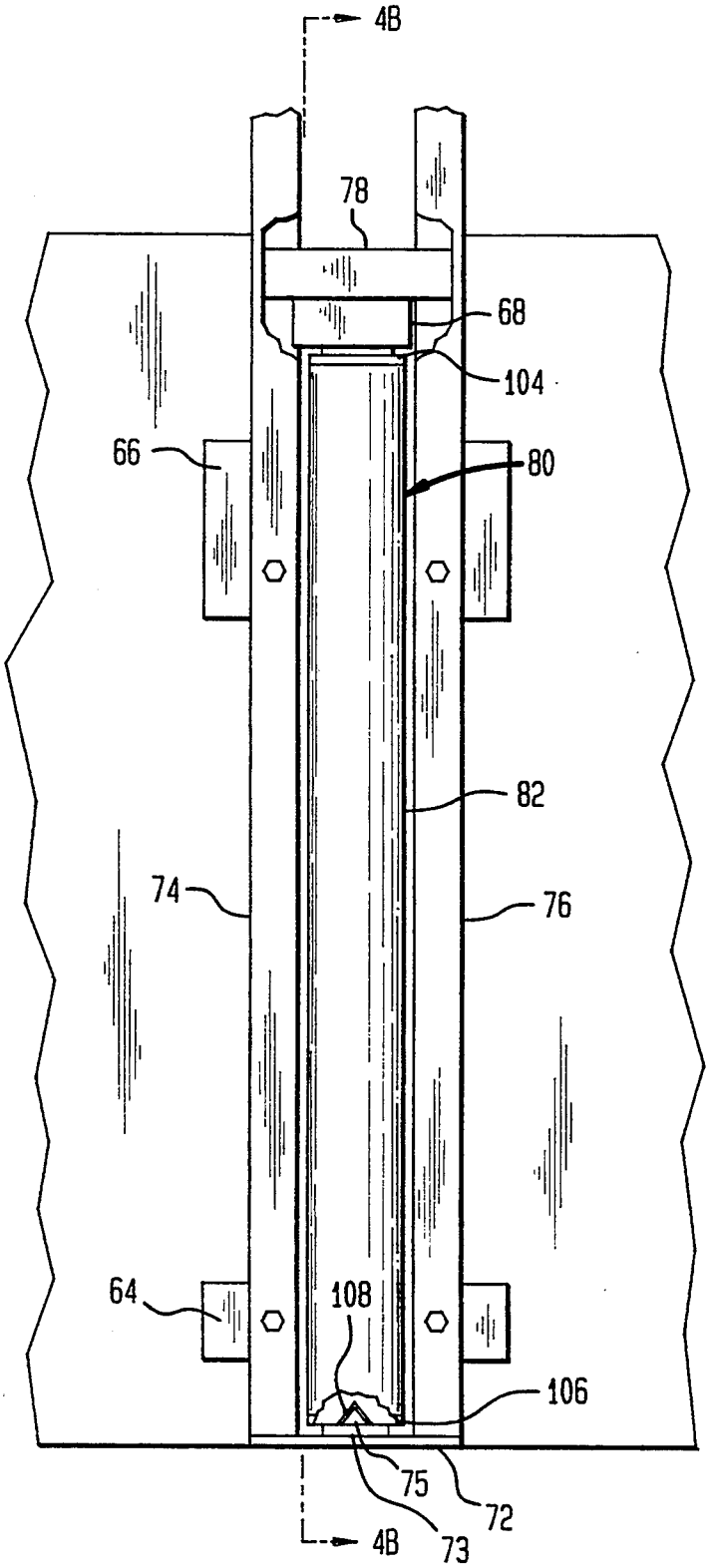
FIG. 4A is a front elevational view of the floating fluid actuated cylinder according to the present invention in combination with an immersion parts cleaning device.
Figure 4B:
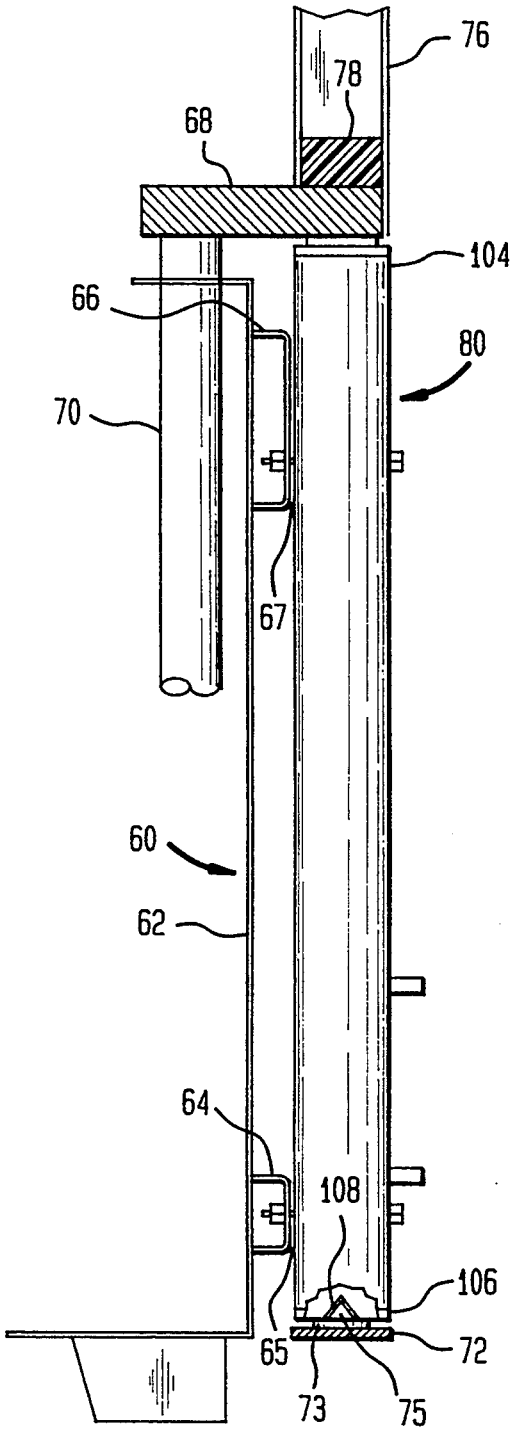
FIG. 4B is a partial cross-sectional view along line 4B—4B of FIG. 4A.
Figure 7:
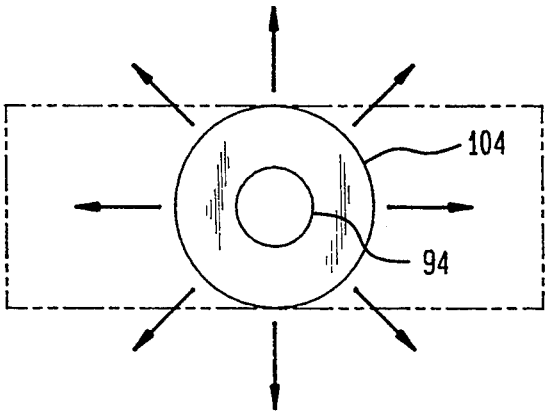
FIG. 7 is a top planar view of the cylinder shown in FIGS. 4A and 4B.

Referring to FIGS. 4A and 4B, the floating fluid actuated cylinder 80 of the present invention is shown in conjunction with an industrial parts washer. The present invention includes a novel pivot bearing arrangement which allows the cylinder 80 to move or float such that the cylinder can align itself under the bending torques to prevent premature piston and/or cylinder wear and eventual failure. In particular, the cylinder body is mounted to the tank such that the upper portion of the cylinder 80 can move laterally in any orbital direction (360° ) as shown in FIG. 7 when bending torques are applied to the piston rod of the cylinder. These bending torques are greatest when the piston rod is in its fully extended position. As such, the present invention further provides means for reducing the bending torque on the piston rod itself.

The industrial parts washer comprises a tank 60 and includes a rear side wall 62. The cylinder 80 is secured to the rear side wall 62 of the tank 60 by a mounting assembly comprising a pair of vertically extending U-shaped guide channels 74 and 76, the open portion of the channels being in opposing relationship with each other. A horizontally extending bottom mounting plate 72 couples the pair of guide channels 74 and 76 together at their lower most ends and supports the lower most end of cylinder body 82. The mounting assembly further includes an upper spacer bracket 66 and lower spacer bracket 64 which are vertically spaced from each other. The spacer brackets are attached to the rear side wall of the tank by welding or like means and allow the guide channels to be attached to the rear side wall using simple fasteners.

Figure 1:
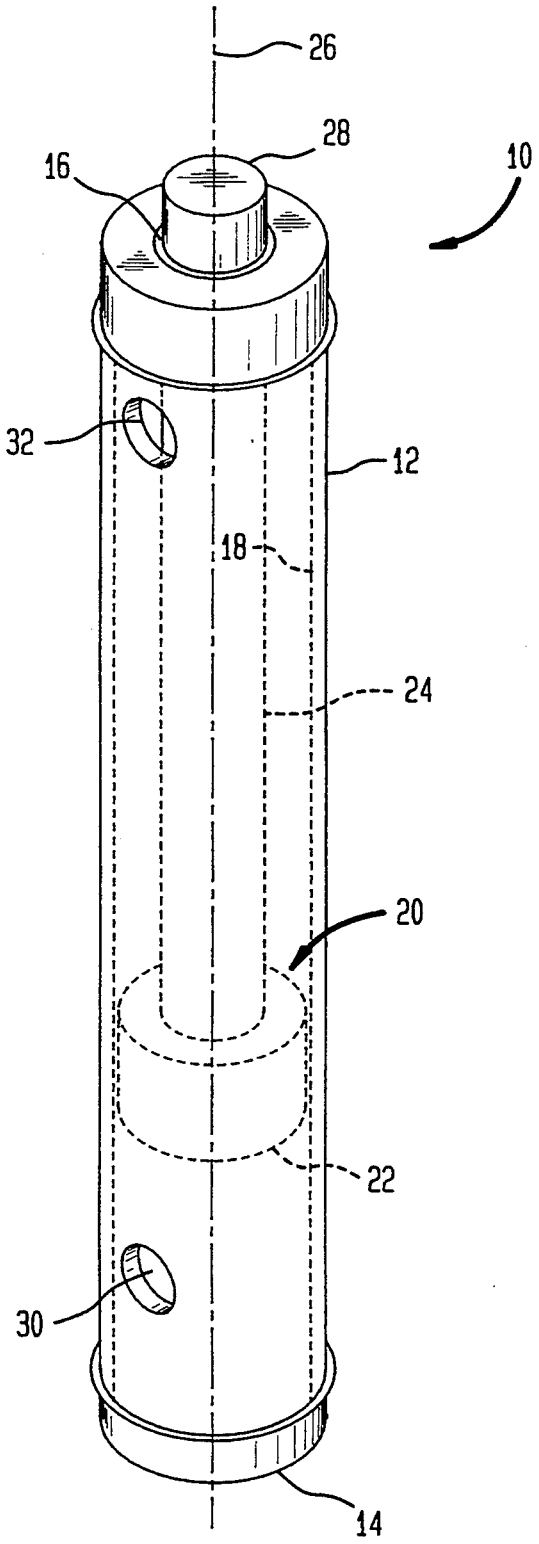
FIG. 1 (PRIOR ART)
FIG. 1 is a perspective view of a prior art fluid actuated cylinder.
Figure 2A:
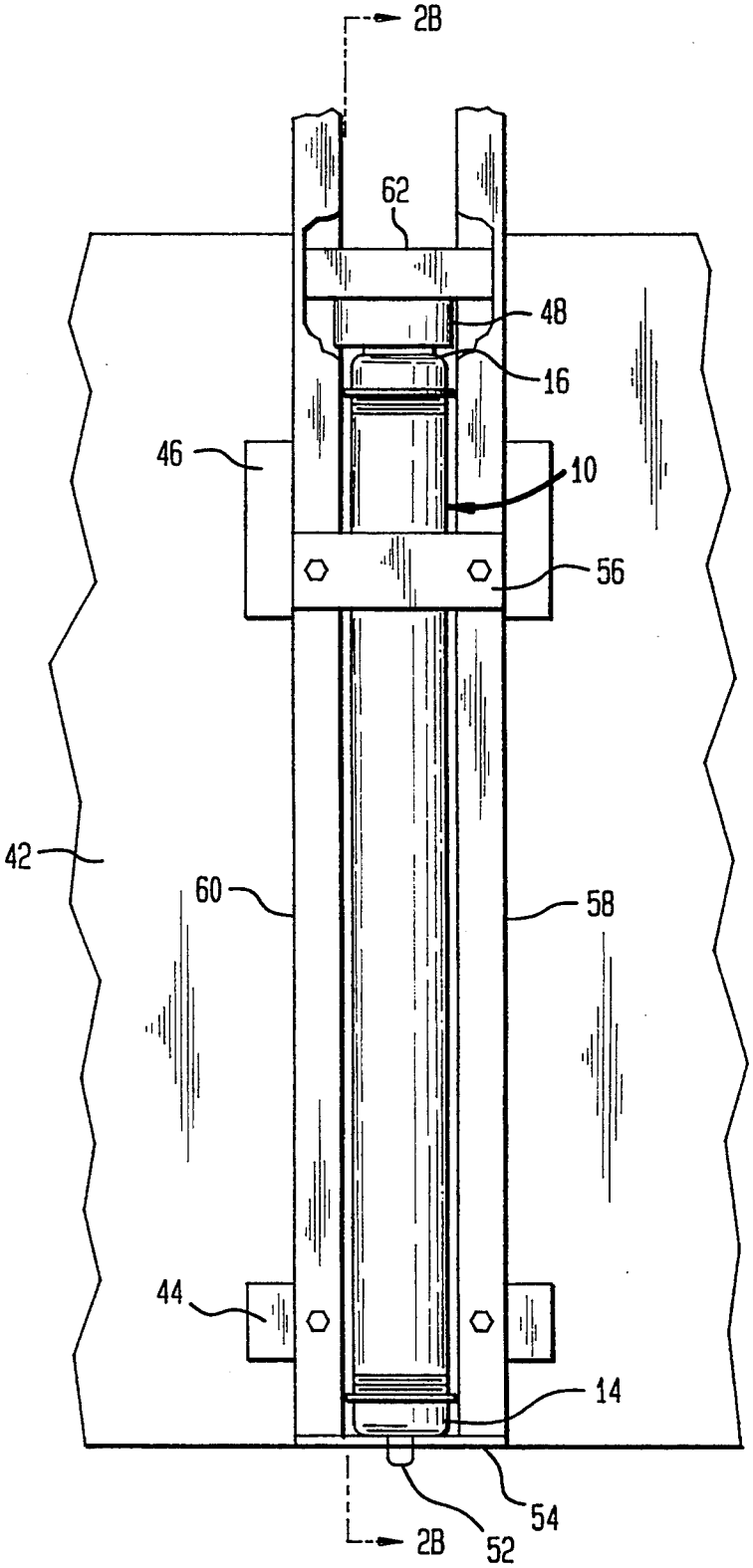
FIG. 2A (PRIOR ART)
FIG. 2A is a front elevational view of the prior art fluid actuated cylinder of FIG. 1 shown in combination with an immersion parts cleaning device.
Figure 2B:
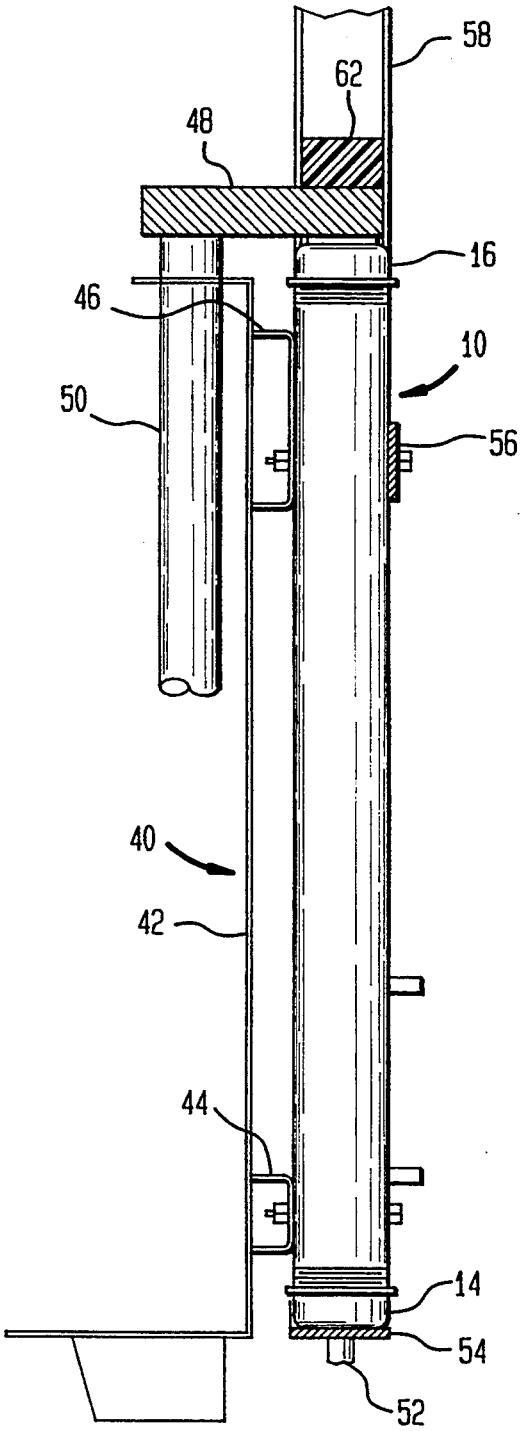
FIG. 2B (PRIOR ART)
FIG. 2B is a partial cross-sectional view along line 2B—2B of FIG. 2A.

The free end 98 of the piston rod 84 is coupled to the object to be immersed using the same arrangement as described earlier with respect to the prior art arrangement shown in FIGS. 2A and 2B. In particular, the free end 98 is coupled to a horizontally extending linkage member 68 which extends over the interior of the tank 60. An elevator shaft 70 depends vertically from the linkage member 68. The end of the elevator shaft 70 is adapted to hold a basket (not shown) which contains the parts to be immersed within the cleaning fluid of the tank 60. A sliding block 78 is coupled to the linkage member 68 just above the free end 98 of piston rod 84. Each end of the sliding block 78 rides up and down in a corresponding guide channel to vertically guide the linkage 68 and elevator shaft 70 such that the basket is lowered in and raised out of the tank 60 as the piston rod assembly 90 reciprocates within the cylinder body 82.

The cylinder 80 is made to float by providing a novel pivot bearing arrangement which comprises the above-described end cap 106 of the cylinder 80 and a disc like bearing member 73 disposed on the bottom mounting plate 72. As shown in FIG. 5A, the bearing member 73 preferably includes a dowel member 77 depending from its bottom surface which is press-fittingly engaged in aperture 79 in the bottom mounting plate 72. It is understood, however, that bearing member 73 can be attached to the bottom mounting plate in any suitable manner such as welding or the like.

Referring to the exploded views of FIGS. 5A and 5B, the bearing member 73 further includes a centrally located conically shaped protrusion 75 on its upper surface or bearing surface 71. When the cylinder 80 is mounted to the tank 60, the bearing surface 107 of the end cap 106 of the cylinder 80 is supported on the bearing surface 71 of the bearing member 73. The protrusion 75 mates with recess 108 to prevent the end cap 106 from sliding laterally across the bearing member 73, thus retaining the axial alignment of the bearing surfaces. The conical profiles of the recess and protrusion, however, allow the bearing surface 107 of the end cap 106 to freely pivot on the bearing surface 71 of the bearing member 73.

Floating of the cylinder 80 is further provided by adapting the upper and lower spacer brackets 66 and 64 such that respective clearances 67 and 65 are provided between each bracket and the cylinder body 82. Further, the upper mounting plate used to secure the upper marginal end of the cylinder body in the prior art arrangement is omitted in the present invention.

The pivot bearing arrangement, the clearances, and the omitted upper mounting plate allow the cylinder 80 to move or float such that the cylinder can align itself under the bending torques to prevent premature cylinder wear and eventual failure. In particular, the cylinder body 82 is capable of rotating on the bearing member 73 which is indicative of absence of any load on the cylinder body 82.

Thus, as the piston rod assembly reciprocates within the cylinder thereby causing the piston rod to experience bending torques, the upper portion of the cylinder 80 can now move laterally in any orbital direction (360° ) as shown in FIG. 7. This motion occurs as the end cap 106 of the cylinder 80 pivots on the bearing member 73. The lateral movement of the upper portion of the cylinder alters the overall geometry of between the linkage and cylinder making it less severe and more linear. This reduces the severity of the bending torques and reduces wear on the piston and cylinder.

In operation, as the piston rod fully extends and the geometry becomes less linear, the cylinder responds to correct the geometry by pivoting on the bearing member with the upper portion of the cylinder moving a greater distance laterally as the piston rod fully extends. The lateral movement of the cylinder in effect realigns the cylinder with the linkage and reduces the non-linearity of the linkage geometry.

The bushing provided in the second end of the cylinder reduces the bending moment of the piston rod and reduces the likelihood of the piston rod becoming bent.

It is understood that the embodiment of the floating cylinder described herein is merely exemplary and that a person skilled in the art may make many variations and modifications to the described embodiment utilizing functionally equivalent components to those herein described.

All such variations and modifications are intended to be included within the scope of this invention as defined by the appended claims.

We claim:

1. A fluid actuated cylinder in combination with a container, said cylinder operating to lower an object into said container and to raise the object out of said container thereby subjecting said cylinder to bending torques, comprising:

cylinder floating means including a first member on said cylinder in continuous contact with a second member on said container for allowing said cylinder to move laterally in an orbital motion with respect to said container when said cylinder is subjected to the bending torques resulting from the lowering and raising of the object.

2. The fluid actuated cylinder and container according to claim 1, further comprising a piston rod and a bushing disposed within an end of said cylinder, said piston rod extending through said bushing to reduce bending of said piston rod caused by the bending torques.

3. The fluid actuated cylinder and container according to claim 1, further comprising spacer means associated with said container for spacing said cylinder away from said container.

4. The fluid actuated cylinder and container according to claim 3, wherein said cylinder floating means further comprises a clearance between said cylinder and said spacer means for allowing said orbital motion of said cylinder.

5. The fluid actuated cylinder and container according to claim 4, wherein said first member of said cylinder floating means comprises a first bearing surface and said second member of said cylinder floating means comprises a second bearing surface, a protrusion disposed on one of said first and second bearing surfaces, and a recess disposed on the other of first and second bearing surfaces, whereby said first and second bearing surfaces coact to allow said cylinder to pivot with respect to said container thereby allowing said end of said cylinder to move laterally in said orbital motion, said protrusion being continuously received in said recess of said second bearing surface for maintaining axial alignment of said first and second bearing surfaces.

6. The fluid actuated cylinder and container according to claim 5, wherein said protrusion and said recess are each conically shaped.

7. The fluid actuated cylinder and container according to claim 1, wherein said first member of said cylinder floating means comprises a first bearing surface and said second member of said cylinder floating means comprises a second bearing surface, a protrusion disposed on one of said first and second bearing surfaces, and a recess disposed on the other of first and second bearing surfaces, whereby said first and second bearing surfaces coact to allow said cylinder to pivot with respect to said container thereby allowing said end of said cylinder to move laterally in said orbital motion, said protrusion being continuously received in said recess of said second bearing surface for maintaining axial alignment of said first and second bearing surfaces.

8. The fluid actuated cylinder and container according to claim 7, wherein said protrusion and said recess are each conically shaped.

9. A fluid actuated cylinder comprising:

a cylinder body having a first end, a second end;

a piston rod assembly which reciprocates within said cylinder body, said piston rod assembly including a piston rod extending through said first end of said cylinder body; and cylinder floating means formed on said second end of said cylinder body for allowing said first end of said cylinder body to move laterally in an orbital motion with respect to an object to which said cylinder is to be mounted to, when said cylinder is subjected to bending torques applied during the reciprocation of said piston rod assembly within said cylinder body, said cylinder floating means comprising a recess which is adapted for the continuous receipt of a corresponding protrusion disposed on a portion of the object to which said cylinder is to be mounted to.

10. The fluid actuated cylinder according to claim 9, further comprising a bushing disposed within said first end of said cylinder body, said piston rod extending through said bushing to reduce bending of said piston rod from the bending torques applied thereto.

11. The fluid actuated cylinder according to claim 9, wherein said recess is conically shaped.

12. An apparatus for lowering at least one object into a fluid and then raising said at least one object out of said fluid, said lowering and raising causing bending torques to be applied to said apparatus, comprising:

a fluid actuated cylinder;

fluid holding means for containing the fluid;

cylinder mounting means for mounting said cylinder to said fluid holding means; and cylinder floating means including a first member on said cylinder mounting means in continuous contact with a second member on said cylinder for allowing said cylinder to move laterally in an orbital motion with respect to said cylinder mounting means when said cylinder is subjected to bending torques resulting from the lowering and raising of the at least one object.

13. The apparatus according to claim 12, wherein said first member comprises a first bearing surface for supporting an end of said cylinder.

14. The apparatus according to claim 13, wherein said cylinder mounting means further comprises spacer means for spacing said cylinder mounting means away from said fluid holding means.

15. The apparatus according to claim 14, wherein said cylinder floating means comprises a clearance between said cylinder and said spacer means for allowing said orbital motion of said cylinder.

16. The apparatus according to claim 15, wherein said second member comprises a second bearing surface on said end of said cylinder, wherein said first and second bearing surfaces continuously coact to allow said end of said cylinder to pivot on said mounting means thereby allowing a second end of said cylinder to move laterally in said orbital motion.

17. The apparatus according to claim 16, wherein one of said first and second bearing surfaces include a protrusion and the other of said first and second bearing surfaces includes a recess for receiving said protrusion, said protrusion and said recess operating to maintain axial alignment of said first and second bearing surfaces.

18. The apparatus according to claim 12, further comprising a piston rod and a bushing disposed within an end of said cylinder, said piston rod extending through said bushing to reduce bending of said piston rod caused by the bending torques.

* * * * *